United States Patent [19]

Beerens

[11] 4,210,064

[45] Jul. 1, 1980

[54] METHOD AND DEVICE FOR BRAKING THE SPEED OF MOVEMENT OF THE PISTON OF A PLUNGER-CYLINDER DEVICE

[75] Inventor: Josephus J. Beerens, Liempde, Netherlands

[73] Assignee: Hydraudyne B.V., Boxtel, Netherlands

[21] Appl. No.: 868,316

[22] Filed: Jan. 10, 1978

[30] Foreign Application Priority Data

Jan. 10, 1977 [NL] Netherlands ..... 7700188

[51] Int. Cl.[2] ..... F15B 15/22; F01B 11/02

[52] U.S. Cl. ..... 91/394; 91/452; 91/454; 92/85 B

[58] Field of Search ..... 91/394; 92/143, 85 B, 92/8-12, 62

[56] References Cited

U.S. PATENT DOCUMENTS

| | | | |
|---|---|---|---|
| 3,162,578 | 12/1964 | Allen | 92/85 B |
| 3,631,760 | 1/1972 | Moran | 92/143 |
| 3,933,080 | 1/1976 | Corrie | 91/394 |

FOREIGN PATENT DOCUMENTS

| | | | |
|---|---|---|---|
| 2031790 | 1/1972 | Fed. Rep. of Germany | 92/85 B |

*Primary Examiner*—Paul E. Maslousky
*Attorney, Agent, or Firm*—John P. Snyder

[57] ABSTRACT

Method and device for braking the speed of movement of the piston of a plunger-cylinder device by choking the outlet of medium on the side of the piston approaching the end wall of the cylinder and by coupling the piston rod of the cylinder with the piston of a second plunger-cylinder device.

7 Claims, 1 Drawing Figure

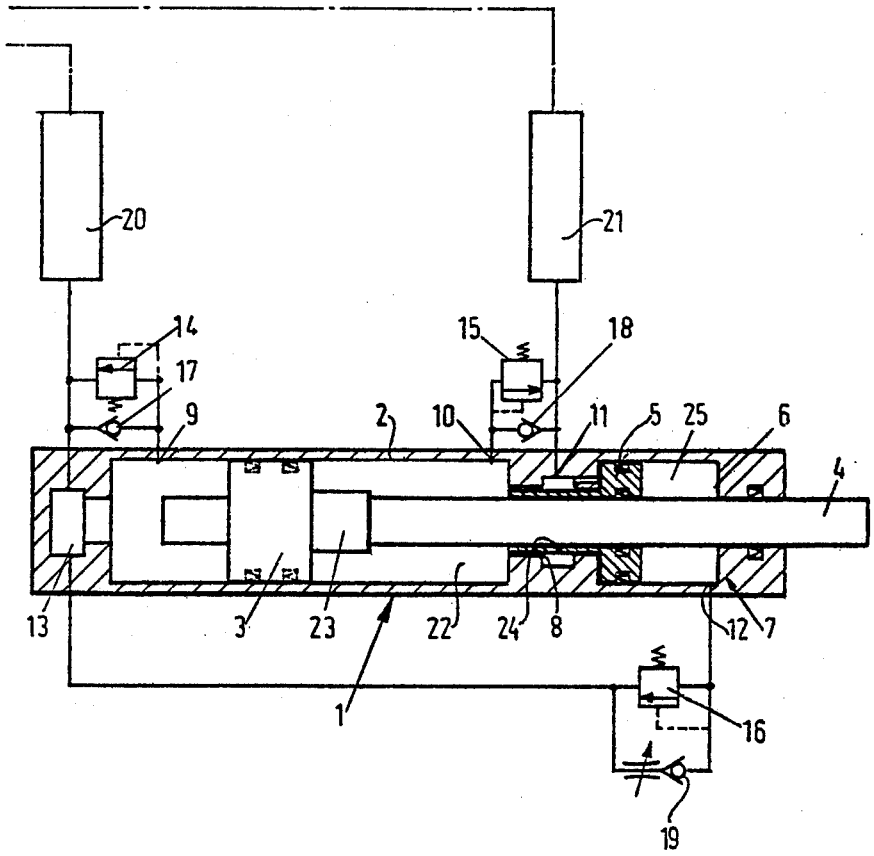
20
21
14
17
9
15
18
2
10
11
5
25
6
4
13
3
23
22
24
8
12
7
1
16
19

METHOD AND DEVICE FOR BRAKING THE SPEED OF MOVEMENT OF THE PISTON OF A PLUNGER-CYLINDER DEVICE

The invention relates to a method and a device for braking the speed of movement of the piston of a plunger-cylinder device at the approach of the end of the stroke, said cylinder having at one end a junction for the supply and the outlet respectively of medium, the outlet of medium being choked upon the approach of the piston. Choking of the outlet of medium at the end of the stroke produces in the cylinder space on the side of the piston rod an increase in pressure so that the piston is subjected to a braking force. In this way the piston is prevented from striking the end wall of the cylinder with a heavy force at the end of the stroke.

In a plunger-cylinder device the effective surface of the piston on the side remote from the piston rod is larger than on the side of the piston rod. This difference may be considerable in the case of thick piston rods (plungers). Therefore, in order to obtain an adequate braking effect at the end of the stroke, particularly in devices comprising a thick piston rod, the pressure in the cylinder space on the side of the piston rod has to be raised quite considerably. As a matter of course, the risk of a collapse of the cylinder under such a pressure is an inhibiting factor. Consequently, the magnitude of the braking force at the end of the stroke is subjected to limitations.

The invention has for its object to provide, for the aforesaid conditions, a method and a device which permit of obtaining nevertheless such a braking effect that the piston can reach the end of the stroke with acceptable speed. According to the invention this is achieved by coupling the piston rod upon the approach of at least one of the ends of the stroke with a member moving simultaneously and producing a force opposing the movement of the piston rod.

Apart from the braking effect of the increase in pressure in the cylinder space on the side of the piston rod, a braking effect is thus obtained by the counter-force exerted on the piston rod. This counter-force can be obtained by constructing said member in the form of a piston rod of a plunger-cylinder device, in which the outlet of medium at the end of the cylinder remote from the piston rod is choked upon the approach of the piston. In this way it is ensured that the medium pressure required for obtaining a sufficiently high braking force is divided among two cylinder spaces. Consequently, the pressure in each of the cylinder spaces can be kept materially below the critical value.

The method described above may be carried into effect by means of a plunger-cylinder combination provided with a plunger-cylinder device having at both ends of the cylinder a connection for the supply and outlet respectively of medium, whilst upon the approach of the piston the connection for the medium outlet is choked and the piston rod has a control member, there being provided a second plunger-cylinder device in a manner such that when the piston of the first plunger-cylinder device approaches the end of the stroke, said control-member engages the piston of the second plunger-cylinder device and displaces the same.

Consequently, during the last part of the stroke of the piston rod of the first plunger-cylinder device the piston rod of the second plunger-cylinder is displaced and the two cylinder spaces on the side of the piston rod are reduced accordingly. In these cylinder spaces pressure is, therefore, built up in a corresponding manner.

The piston rod of the first plunger-cylinder device is passed through a bore in the piston and the piston rod and the cylinder bottom of the second plunger-cylinder device. The control-member on the piston rod of the first plunger-cylinder device may be formed by a thickened portion of the piston rod provided at a distance from the piston.

The invention will be described more fully with reference to the accompanying drawing, which schematically shows the device embodying the invention.

The first (or main) plunger-cylinder device 1 comprises a cylinder 2 and a piston 3 with a piston rod 4 adapted to move therein. The piston rod 4 passes through a bore in the piston 5 and a bore in the cylinder bottom 6 of the second (or auxiliary) plunger-cylinder device 7. The cylinders of the two plunger devices communicate with one another through a channel 8 which is blocked by the thickened portion 23 in the extreme position of the piston 3. Near the ends of the respective cylinders connections 9,10,11,12 respectively are provided for the supply and outlet respectively of medium. The connecting conduits 9,10,12 include each a non-return valve 17,18 and 19 respectively and a safety valve 14,15 and 16 respectively. The sources of energy are formed by the pressure vessels 20 and 21.

When the end of the stroke (in the FIGURE on the right-hand side in the cylinder) is approached by the piston rod 4, the thickened portion 23 engages the hollow piston rod 24 connected with the piston 5 and blocks the channel 8. During the continuation of the movement the piston 5 is moved to the right as shown in the drawing. The medium is expelled through the safety valves 15 and 16 out of the cylinder spaces 22 and 25 respectively. The pressures in said cylinder spaces attain the value adjusted by the safety valves and the braking force exerted on the piston 3 is equal to the pressure of the magnitude defined by the safety valve 15 multiplied by the operative piston surface on the side of the piston rod 4 plus the pressure value defined by the safety valve 16 multiplied by the operative surface of the piston 5 on the side of the cylinder space 25. These operative surfaces need not be equal to one another.

Therefore, the pressure in the cylinder space 22 can be kept lower than in the absence of the auxiliary plunger-cylinder device 7, since the pressure required for braking is distributed across a larger piston portion, that is to say, the operative portions of the pistons 5 and 3. In each of the cylinder spaces 22 and 25 the pressure remains comparatively low.

It should be noted that the method and device embodying the invention may be employed with air as well as with a hydraulic fluid as a medium.

It is furthermore noted that the invention is not limited to the embodiment shown. It is, for example, possible to use different kinds of choking systems. The braking force exerted on the moving piston may be constant or, as an alternative, be chosen to be dependent upon the speed of the piston. Moreover, a closed system may be used in which the braking force depends upon the displaced volume of medium. These methods of choking are known per se and do not form part of this invention.

The invention may, of course, also be applied to the side of the piston remote from the piston rod, that is to say, on the side facing the cylinder bottom.

What I claim is:

1. The method of braking the speed of movement of the piston of a plunger/cylinder device upon the approach of the end of the stroke of said piston, which comprises the steps of:

(a) trapping fluid ahead of said piston as the end of stroke is approached whereby predetermined pressure build-up of fluid occurs ahead of said piston thereby to brake movement of the piston; and (b) during step (a), commencing drive movement of a second piston in a separate piston/cylinder device by intercepting the movement of the first piston and compressing fluid ahead of the second piston in the separate piston/cylinder device whereby the braking force on the first piston is divided between the fluid pressures being built up within both devices so that the cylinder of neither device is subjected to excessive fluid pressure.

2. The method as defined in claim 1 wherein steps (a) and (b) are effected substantially simultaneously.

3. In a fluid drive device which comprises a cylinder, a piston reciprocable within said cylinder, a plunger connected to said piston and projecting outwardly from said cylinder to impart external drive movement, and means for introducing fluid under pressure behind said piston while exhausting fluid ahead of said piston to move the latter through a predetermined stroke, the improvement which comprises means for braking movement of said piston as the end of said stroke is approached without subjecting said cylinder to excessive fluid pressure ahead of said piston, said means comprising a second piston, a second cylinder within which said second piston is movable, means for venting fluid ahead of said second piston under predetermined pressure, said second cylinder being coaxial with the first mentioned cylinder and said plunger slidably passing through said second piston and projecting outwardly from said second cylinder, abutment means for causing said second piston to move with said first piston as said end of stroke is approached, and means for venting fluid under predetermined pressure ahead of said first piston during joint movements of both pistons whereby braking force acting against said first piston is divided between the fluids ahead of both pistons.

4. In a device as defined in claim 3 wherein said cylinders communicate normally through a bore surrounding said plunger, said second piston includes a sleeve normally disposed within said bore, and said abutment means comprises a shoulder movable into said bore to block same and engage the sleeve of said second piston.

5. In a device as defined in claim 4 wherein said bore is provided with an exhaust outlet for the fluid ahead of said first piston and said means for venting communicates directly with said first cylinder.

6. In a fluid-actuated device, the combination of:

a cylinder assembly having first and second coaxial but longitudinally spaced cylinder spaces therein, said cylinder spaces being connected by an axial bore;

a first piston reciprocable in one cylinder space and a plunger connected to said first piston and projecting therefrom through said bore, the other cylinder space and outwardly of said cylinder assembly, said plunger being of smaller diameter than said bore;

a second piston reciprocable in the other cylinder space in surrounding, slidable relation to said plunger, said second piston including a sleeve of smaller diameter than and receivable in said bore;

fluid pressure supply means having an inlet connection with the opposite ends of said cylinder assembly and an exhaust connection within said bore whereby said first piston is forced toward said second piston while said second piston is forced toward said first piston to bottom it within one end of said other cylinder space and position said sleeve within said bore;

means for venting each cylinder space under predetermined pressure ahead of each respective piston; and abutment means for causing said second piston to move with said first piston as the latter approaches said bore.

7. In a device as defined in claim 6 wherein said abutment means comprises a shoulder movable with said first piston into said bore in blocking relation therewith and in engagement with said sleeve.

* * * * *